US006241833B1

(12) United States Patent
Brown

(10) Patent No.: US 6,241,833 B1
(45) **Date of Patent: *Jun. 5, 2001**

(54) HIGH ENERGY GUN PROPELLANTS

(75) Inventor: Lisa G. Brown, Pulaski, VA (US)

(73) Assignee: Alliant Techsystems, Inc., Hopkins, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,744

(22) Filed: Jul. 16, 1998

(51) Int. Cl.[7] ..... C06B 45/10; C06B 25/34
(52) U.S. Cl. ..... 149/19.8; 149/92
(58) Field of Search ..... 149/19.8, 92

(56) References Cited

U.S. PATENT DOCUMENTS

| | | | |
|---|---|---|---|
| 3,378,611 | 4/1968 | Kincaid et al. . | |
| 3,715,414 | 2/1973 | Schultz et al. . | |
| 3,894,894 | 7/1975 | Elrick . | |
| 4,386,978 | 6/1983 | Baczuk et al. . | |
| 5,325,782 | 7/1994 | Strauss et al. . | |
| 5,482,581 | 1/1996 | Urenovitch . | |
| 5,487,851 | 1/1996 | Dillehay et al. . | |
| 5,500,060 | 3/1996 | Holt et al. | 149/19.1 |
| 5,520,756 | 5/1996 | Zeigler . | |
| 5,567,912 * | 10/1996 | Manning et al. | 149/12 |
| 5,798,481 * | 8/1998 | Manning et al. | 149/19.8 |

FOREIGN PATENT DOCUMENTS

| | | |
|---|---|---|
| 0 353 961A | 2/1990 | (EP) . |

* cited by examiner

*Primary Examiner*—Michael J. Carone
*Assistant Examiner*—Aileen J. Baker
(74) *Attorney, Agent, or Firm*—Nikolai, Mersereau & Dietz, P.A.

(57) ABSTRACT

A low sensitivity gun propellant is disclosed having improved impetus and ballistic potential comprising RDX particles combined with at least one matrix component and plasticizer components including nitroglycerin and amounts of methyl nitrato ethyl nitramine and ethyl nitrate ethyl nitramine.

12 Claims, No Drawings

HIGH ENERGY GUN PROPELLANTS

BACKGROUND OF THE INVENTION

I. Field of the Invention

The present invention is directed generally to improvements in high energy propellant compositions, particularly with regard to the use of alternate ingredients to improve energetic qualities and increase bulk loading density without increasing impact, shock or friction sensitivity. More particularly, the invention allows the use of a relatively large amount of 1,3,5-trinitro-1,3,5-triaza-cyclohexane (cyclo trimethyl trinitramine) usually referred to as cyclonite or (RDX) in double-based compositions to increase energy output and achieve greater bulk loading densities without increasing impact, shock or friction sensitivity by adding the RDX in combination with an amount of nitrato ethyl nitramines (NENAs) as ingredients in the high energy propellants. In this manner, greater bulk loading densities and energy outputs are achieved without additional risk. The invention is particularly suitable for granular loaded tank ammunition.

II. Related Art

Most conventional propellants including propellants used in conventional artillery including 120 mm tank ammunition, and particularly those that are poly-based, use a matrix component, usually nitrocellulose (NC), in combination with nitroglycerine (NG), which also acts as a high energy plasticizer for the NC, together with an amount of an energy adjusting component such as an energetic solid exemplified by cyclo trimethyl trinitramine (RDX), cyclo tetramethyl trinitramine usually referred to as homocyclonite or (HMX), ethylene di-nitramine (EDNA), and others. Diethylene glycol dinitrate (DEGDN) and triethylene glycol dinitrate (TEGDN) are also employed as conventional primary high energy adjustment components. However, the use of these materials in propellant formulae is discouraged because, while these materials enable a propellant to obtain and maintain a high energy level, they, at the same time, impose rather serious safety limitations as these materials may easily be set off or initiated by heat, impact and/or shock. Generally, efforts directed to reducing one or more of these sensitivities have also resulted in reducing the energetic output of the propellant. Heat sensitivity has proved to be somewhat less of a problem to overcome than impact or shock, however. RDX, for example, has a high shock but relatively low thermal sensitivity.

Plasticizers which have high energy output are known as high energy adjustment/plasticizing compounds (HEAPCs). These include NENAs and other such compounds. In the past, several approaches have been used in an effort to reduce the risks associated with sensitive materials while attempting to minimize the associated reduction in energetic output of the overall composition. One such approach has involved the elimination or very limited use of shock-sensitive high energy adjustment plasticizing compounds such as RDX, HMX and the like. In this manner, these components have been replaced with various other known high energy plasticizer components as plasticizers for nitrocellulose (NC), for example, including nitroglycerine (NG), acetyl triethyl citrate (ATEC) and a variety of nitrated acetals and others with some success.

However, RDX is a low cost primary high energy adjustment component with particularly desirable attributes. These include the ability to increase overall propellant impetus or performance and also to increase the density of the propellant grains which allows for greater bulk loading density in the shell case as compared to conventional propellants in similar geometries. Thus, if the sensitivity of the RDX-containing formulations could be decreased without reducing or eliminating the RDX, formulae with superior performance could be achieved.

RDX has been added to JA-2, conventional tank and artillery propellant in the past to achieve advanced ballistic performance. However, it has been reported that researchers at Army Research Laboratory (ARL) found RDX crystals on the surface of the JA-X propellant during aging. These researchers theorize that the RDX, partially dissolved in the DEGDN fraction, was carried to the surface of the granules as the DEGDN began to leach out at higher temperatures. This crystalline growth on the surface is a significant sensitivity hazard, and greatly increases the likelihood of initiation due to unplanned mechanical stimuli. For this and other reasons, including the inherent sensitive nature of RDX, the use of RDX in artillery propellant compositions, has been generally discouraged.

The use of nitratro ethyl nitramine (NENA) compounds in propellant formulae is known. U.S. Pat. No. 5,482,581 to Urenovitch discloses low vulnerability propellant (LOVA) containing mixtures of alkyl nitrato ethyl nitramines (alykyl NENAs) and/or bis (2-nitroxy-ethyl) nitramine (DINA) with nitrocellulose (NC). A further U.S. Pat. No. to Zeigler, 5,520,756, also discloses the use of alkyl nitrato ethyl nitramine in combination in nitrocellulose/nitroguanidine double based propellants which may also contain cyclonites (RDX).

U.S. Pat. No. 5,325,782 to Strauss et al incorporates a cyclic nitramine in the form of 2-nitroimino-5-nitrohexahydro-1,3,5 triazine (NNHT) which may be combined with methyl and ethyl NENA, nitrocellulose and RDX. Dillehay et al (U.S. Pat No. 5,487,851) also shows the possible use of alkyl NENA compounds in LOVA propellants which may contain RDX.

It would present an advantage if a significant amount of the low cost high energetic propellant ingredient RDX could be utilized to increase the propellant impetus and loading density in a manner which does not cause the propellant composition to be more sensitive to heat, impact and/or shock. This is especially true with respect to munitions for tank guns.

Accordingly, it is a principal object of the present invention to obtain an insensitive, high energy polybased propellant composition.

It is also a principal object of the present invention to provide a propellant for artillery weapon systems having improved energetic properties with respect to conventional JA-2 without sacrificing safety or increasing the sensitivity threshold initiation levels (TIL).

Another object of the invention is to increase the impetus of propellant compositions by adding a relatively large amount of RDX without increasing the sensitivity of the propellant.

A further object of the invention is to provide artillery propellant matrices containing ethyl and methyl NENA in combination with relatively large amounts of RDX.

A still further object of the invention is to provide artillery propellant matrices including ethyl and methyl NENAs and RDX that offer impetus and shock sensitivity advantages over formulae using NG and DEGDN plasticizers.

Other objects and advantages will become apparent to those skilled in the art upon becoming familiar with the present specification together with the appended claims.

SUMMARY OF THE INVENTION

The present invention attains the above and other objects by providing a multi-based propellant of improved energy output that retains the low sensitivity characteristics of conventional double-based propellant compositions such as JA-2. This is accomplished in the detailed embodiments by utilizing a rather large fraction of RDX in combination with amounts of NENAs and particularly ethyl and methyl NENAs to replace a fraction of the NC and NG and all of the DEGDN in the JA-2 or other such NC/NG double-based propellant containing DEGDN or TEGDN as a primary high energy adjustment component. The amount of RDX that can be safely added is between about 20 percent and about 40 percent and the amount of NENAs is about 15 percent to 22 percent.

Ballistic simulations indicate that up to a 1.7 percent increase in muzzle velocity can be obtained using 19-perf hex granules based on bench scale batches of the material. Three experimental formulations containing approximately 25 percent, 30 percent and 34 percent 5-micron particle size RDX (by weight), respectively, have been tested. These formulations have demonstrated the feasibility of combining RDX and NENAs to increase the impetus of propellants while retaining the sensitivity characteristics of conventional propellants such as JA-2. Ballistic simulations indicate that the 1.7 percent increase in muzzle velocity can be obtained without increasing the sensitivity of the composition.

The preferred NENA compounds include nitrato ethyl nitramine of the formula

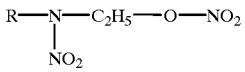

in which R is defined as a member selected from $CH_3$— and $C_2H_5$—.

The term "effective amount" as applied to the HEAPC component is defined as an amount of one or more nitrato ethyl nitramine(s) capable of forming a high energy colloided extrudable mass with a matrix component as herein defined and additionally capable of supplementing an active amount of high energy adjustment components to obtain a lower level of both thermal and shock sensitivity.

The term "matrix component", for purposes of the present invention, is defined as one or more of a dehydratable nitrocellulose, cellulose acetate, cellulose acetate butyrate (CAB), ethyl cellulose and the like, it being noted that the energy content between commercial batches of nitrocellulose often vary substantially and, therefore, maximum permissible substitution with alternate, better-controlled matrix material of a less energetic type, such as the butyrate derivative (CAB) can provide substantial advantage in maintaining propellant batch consistency.

The term "primary high energy adjustment component", for purposes of the present invention, is defined as one or more of RDX, HMX, DEGDN and the like, which are utilized in combination with matrix and HEAPC components to obtain a desired energy level of a double (or triple)-based propellant product.

DETAILED DESCRIPTION

As stated above, the propellants of the present invention accomplish the assimilation of RDX in multi-based propellants in a manner which overcomes previous drawbacks which have heretofore discouraged the unclusion of any significant amount of RDX including its inherent impact, friction and shock sensitivity and its tendency to crystallize out of other formulations including those utilizing NG and DEGDN.

Table 1 depicts a comparison of propellant compositions and thermochemicals in which the conventional tank propellant JA-2 is compared with three examples of propellant made in accordance with the present invention. The three example formulations include RPD-20, RPD-21 and RPD-22. As can be seen from Table 1, the impetus (J/g) and ballistic potential J/cc×$10^{-3}$ of all three formulas are significantly higher than that measured for JA-2. The RPD-22 material is particularly noteworthy. In the formulas of the invention, the combination of 5-micron RDX and ethyl and methyl NENA are utilized to replace some of the nitroglycerin and all of the DEGDN in the JA-2 formulation.

TABLE 1

Comparison of Propellant Compositions and Thermochemicals

| INGREDIENTS | JA2 | PRD20 (Measured) | RPDS21 (Measured) | RPDS22 (Measured) |
|---|---|---|---|---|
| NC (13.15% N) | 59.50 | — | — | — |
| NC (12.6% N) | — | 41.90 | 36.48 | 31.11 |
| RDX (5 micron) | — | 25.71 | 30.33 | 34.08 |
| Methyl NENA | — | 14.00 | 13.44 | 12.57 |
| Ethyl NENA | — | 10.00 | 9.57 | 8.94 |
| NG | 14.90 | 7.69 | 9.46 | 12.58 |
| DEGDN | 24.80 | — | — | — |
| Misc. | 0.80 | 0.70 | 0.72 | 0.72 |
| THERMOCHEMICALS | | | | |
| Flame Temp., K. | 3394 | 3372 | 3451 | 3551 |
| Impetus, J/g | 1140.0 | 1205.6 | 1226.1 | 1249.1 |
| Gamma | 1.2248 | 1.2366 | 1.2349 | 1.2324 |
| Ballistic Potential J/cc × 10^3 | 8.0 | 8.4 | 8.6 | 8.9 |
| HOE, cal/g | 1123.3 | 1099.5 | 1129.7 | 1167.3 |

The three RPD formulations were processed through the evenspeed operation to evaluate the burn rates of the formulations. Table 2 is a summary of burn rate data for the three formulations at various temperatures. This burn rate data was derived from 700 cc closed bomb shots at 0.2 g/cc loading density. Note that RPD-22 offers the greatest ballistic advantage for advanced ammunition, specifically an M829A2 round based upon increased impetus, ballistic potential values and burn rate parameters when compared to JA-2. Ambient pressure closed bomb shots were also performed which confirm the extrapolated high pressure burn rates obtained from the 700 cc bomb data.

TABLE 2

Burn Rate Comparison of Experimental Formulations

| | Burn Rate | | | | | | | | |
|---|---|---|---|---|---|---|---|---|---|
| | RPD-20 | | | RPD-21 | | | RDD-22 | | |
| Parameters | −40 F. | 90 F. | 145 F. | −40 F. | 90 F. | 145 F. | −40 F. | 90 F. | 145 F. |
| Exponent(n) | 1.000 | 0.986 | 0.983 | 1.009 | 1.035 | 1.055 | 1.016 | 1.050 | 1.061 |
| Coefficient(r) | 0.0720 | 0.0832 | 0.0903 | 0.0675 | 0.0670 | 0.0642 | 0.0697 | 0.0664 | 0.0662 |

Burn rate data determined using 700 cc closed bomb at 0.2 loading density, where r=a*P^n and units are r=cm/s, P=MPa.

Further, during the processing of the three formulations, sensitivity testing was performed particularly on the RPD-22 paced because it was believed to be the most sensitive of the three experimental formulations inasmuch as it has the highest RDX content. Testing was conducted prior to pre-rolling. Similarly, the pre-roll sheets were tested prior to introducing the sheets into the evenspeed roll mill.

TABLE 3

Threshold Initiation Levels (TIL) for Various Propellants to Mechanical Initiation Stimuli*

| | | Friction, lbs @ 8 fps | Impact, cm | ESD, J | TV, % | Th, mils |
|---|---|---|---|---|---|---|
| JA-2 | Paste | 225 | ≥117 | 0.64 | 19.5 | 64 |
| | Preroll | 530 | 80 | 7.81 | 0.7 | 78 |
| 2R40 (JA-2 W/40% 7.5 micron RDX) | Paste | 290 | 33 | 0.13 | 15.5 | 15.18 |
| | Preroll | 130 | 11 | ≥9.4 | 0.17 | 50 |
| M44 | Paste | 225 | 13 | 0.26 | 3.5 | 280 |
| | Preroll | 290 | 51 | 9.45 | 0.6 | 30–40 |
| RPD-22 | Paste | ≥950 | 64 | **NA | 9.5 | 32 |
| | Preroll | 225 | 64 | ≥9.5 | 1.5 | 52 |
| APS-5 | Paste | 140 | 13 | 0.075 | — | — |
| Double-Base Solventless | Finished (dry) | 140 | 11 | 0.075 | — | — |

* The Threshold Initiation Level (TIL) is defined as the highest energy level at which no initiation occurs as evidenced by 20 consecutive failures, with at least one initiation occurring at the next higher test level.
** NA - Not Available -- This test was not performed due the relatively high TV of the sample. The ESD TIL value for dry paste (with a TV of 0.05% and a 31 mil thickness) is 0.125 Joules.

Table 3 is a comparison of Threshold Initiation Levels (TIL) for JA-2, 2R40, M44 and RPD-22 in the paste and pre-roll process states. The table also includes the minimum sensitivity requirements for Aerospace Propulsion Standards (APS-5) for solventless propellant. It is noteworthy that RPD-22 is significantly less sensitive than the minimum sensitivity values in APS-5. Although a direct comparison between RPD-22 and JA-2 reveals that RPD-22 is more impact sensitive, some sensitivity discrepancies between propellants in Table 3 may be attributed to differences in sample thicknesses and moisture contents. In addition, RPD-22 appears less sensitive in the paste and pre-roll process states than does M44 and 2R40 (for the given total volatile content and thickness tested). Thus, testing on bench scale quantities of RPD-22 indicates that this material is generally superior to previous formulations.

TABLE 4

Results of IBHVG2 M829A2 Simulations

| | JA-2 | RPD-22 | | |
|---|---|---|---|---|
| Form | Combination of 19-perf kerfed | 7-perf cyl | 19-perf cyl | 19-perf hex |
| Length, in | sticks, 7-perf | 0.700 | 0.660 | 0.690 |
| Web, in | sticks, and 7-perf | 0.075 | 0.070 | 0.077 |
| Perf Diameter, in | granules | 0.031 | 0.030 | 0.030 |
| Results of IBHVG2 Simulations (at Ambient) | | | | |
| *Charge Weight, lb | 18.86 | 17.00 | 117.50 | 18.00 |
| Muzzle Velocity, ft/s | 5539 | 5555 | 5565 | 5634 |
| Peak Pressure, kpsi | 87.4 | 87.4 | 87.3 | 87.2 |

RPD formulations are between 3.8 and 5.0% more dense than conventional JA-2. This increase in density allows for greater bulk loading densities in the granular form.

Table 4 presents a summary of IBHVG2 M829A2 simulations comparing the current JA-2 kerfed stick charge with RPD-22 and various granulations. This directly illustrates the increase in performance made possible with the three new formulations. Note that the 19-perf hex RPD-22 granulation offers a 1.7 percent increase in muzzle velocity (98 ft/s) at ambient as compared to firing with a JA-2 charge. The RPD formulations are between 3.8 percent and 5.0 percent more dense than conventional JA-2. This higher density allows for greater bulk loading densities in the granular form.

Generally, a propellant containing from about 20 percent to 40 percent (weight) of RDX and 15 percent to 30 percent (weight) of combined methyl and ethyl NENA fractions is preferred. The most preferred range appears to be from about 30 percent to 40 percent (weight) RDX and about 18 percent to 24 percent (weight) total ethyl and methyl NENA. The methyl NENA fraction is preferably about 40 percent greater than the ethyl fraction. The preferred size of the RDX is about 5 microns.

What is claimed is:

1. A multi-based low sensitivity gun propellant having high impetus and ballistic potential comprising at least one matrix compound a major fraction of RDX particles combined with amounts of plasticizer components including nitroglycerin and amounts of methyl nitrato ethyl nitramine and ethyl nitrato ethyl nitramine.

2. The propellant of claim 1 wherein the amount by weight of RDX is from about 20 percent to about 40 percent and the combined amount (weight) of methyl and ethyl nitrato ethyl nitramines is from about 15 percent to about 30 percent.

3. The propellant of claim 1 wherein the matrix components include nitrocellulose.

4. The propellant of claim 2 wherein the amount by weight of RDX is about 35 percent and the combined amount (weight) of methyl and ethyl nitrato ethyl nitramines is about 21.5 percent.

5. The propellant of claim 4 wherein the ratio of nitramines is about 1.4 methyl nitrato ethyl nitramine to 1 ethyl nitrato nitramine.

6. The propellant of claim 2 wherein the amount of nitroglycerin is about 7–13 percent (weight).

7. The propellant of claim 3 wherein the amount by weight of nitrocellulose is from about 25 to about 45 percent.

8. The propellant of claim 7 wherein the amount of nitroglycerin is from about 7 percent to about 13 percent.

9. The propellant of claim 2 wherein the ratio of nitramine is about 1.4 methyl nitrato ethyl nitramine to 1 ethyl nitrato nitramine.

10. A multi-based, DEGDN-free, low sensitivity gun propellant having high impetus and ballistic potential comprising matrix components including nitrocellulose and nitroglycerin and further comprising a major fraction of RDX particles combined with amounts of methyl nitrato ethyl nitramine and ethyl nitrato ethyl nitramine.

11. The gun propellant of claim 10 comprising the following composition by weight:

| | |
|---|---|
| nitrocellulose | 25–45% |
| RDX | 20–40% |
| methyl nitrato ethyl nitramine | 8.5–17.5% |
| ethyl nitrato ethyl nitramine | 6–12.5% |
| nitroglycerin | 7–13% |

12. The gun propellant of claim 10 comprising the following composition by weight:

| | |
|---|---|
| nitrocellulose | 31% |
| RDX | 34% |
| methyl nitrato ethyl nitramine | 12.6% |
| ethyl nitrato ethyl nitramine | 8.9% |
| nitroglycerin | 12.6% |

* * * * *